US009193933B2

(12) United States Patent
Friend et al.

(10) Patent No.: US 9,193,933 B2
(45) Date of Patent: Nov. 24, 2015

(54) LUBRICATING COMPOSITION CONTAINING A DETERGENT

(75) Inventors: Christopher L. Friend, Willoughby, OH (US); William R. S. Barton, Belper (GB); Gary M. Walker, Allestree (GB)

(73) Assignee: The Lubrizol Corporation, Wickliffe, OH (US)

( * ) Notice: Subject to any disclaimer, the term of this patent is extended or adjusted under 35 U.S.C. 154(b) by 245 days.

(21) Appl. No.: 13/996,130

(22) PCT Filed: Dec. 16, 2011

(86) PCT No.: PCT/US2011/065330

§ 371 (c)(1), (2), (4) Date: Jun. 20, 2013

(87) PCT Pub. No.: WO2012/087775

PCT Pub. Date: Jun. 28, 2012

(65) Prior Publication Data

US 2013/0274162 A1 Oct. 17, 2013

Related U.S. Application Data

(60) Provisional application No. 61/425,274, filed on Dec. 21, 2010.

(51) Int. Cl.

| | |
|---|---|
| ***C10M 159/20*** | (2006.01) |
| ***C10M 159/22*** | (2006.01) |
| ***C10M 159/24*** | (2006.01) |
| ***C10M 159/12*** | (2006.01) |

(52) U.S. Cl.

CPC ..... *C10M 159/20* (2013.01); *C10M 159/12* (2013.01); *C10M 159/22* (2013.01); *C10M 159/24* (2013.01); *C10M 2203/1025* (2013.01); *C10M 2207/026* (2013.01); *C10M 2207/027* (2013.01); *C10M 2207/028* (2013.01); *C10M 2207/10* (2013.01); *C10M 2207/144* (2013.01); *C10M 2207/262* (2013.01); *C10M 2207/283* (2013.01); *C10M 2215/064* (2013.01); *C10M 2219/022* (2013.01); *C10M 2219/044* (2013.01); *C10M 2219/046* (2013.01); *C10M 2223/045* (2013.01); *C10M 2223/049* (2013.01); *C10N 2210/01* (2013.01); *C10N 2210/02* (2013.01); *C10N 2220/022* (2013.01); *C10N 2230/06* (2013.01); *C10N 2230/45* (2013.01); *C10N 2230/52* (2013.01); *C10N 2240/04* (2013.01); *C10N 2240/042* (2013.01); *C10N 2240/044* (2013.01); *C10N 2240/045* (2013.01); *C10N 2240/046* (2013.01); *C10N 2240/08* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2240/105* (2013.01); *C10N 2240/14* (2013.01); *C10N 2240/30* (2013.01); *C10N 2250/10* (2013.01); *C10N 2260/14* (2013.01)

(58) Field of Classification Search

USPC ..... 508/433, 392

See application file for complete search history.

(56) References Cited

U.S. PATENT DOCUMENTS

| | | | | |
|---|---|---|---|---|
| 2,716,087 | A | 8/1955 | Woodruff et al. | |
| 3,070,576 | A | 12/1962 | Munns, Jr. et al. | |
| 3,493,516 | A | 2/1970 | Allphin, Jr. et al. | |
| 4,698,170 | A * | 10/1987 | Le Coent | 508/392 |
| 5,883,056 | A * | 3/1999 | Moulin et al. | 508/393 |
| 2005/0184466 | A1 * | 8/2005 | Yoshida et al. | 277/468 |
| 2006/0063685 | A1 * | 3/2006 | Purmer et al. | 508/273 |

FOREIGN PATENT DOCUMENTS

EP 0875502 A1 11/1998

OTHER PUBLICATIONS

O'Connor, S.P., Overbased Lubricant Detergents—a Comparative Study, Lubricating Science, Leaf Coppin Publishing Ltd., US, vol. 6, No. 4, Jan. 1, 1994, pp. 297-325.

* cited by examiner

*Primary Examiner* — James Goloboy

(74) *Attorney, Agent, or Firm* — Michele M. Tyrpak; David M. Shold; Teresan W. Gilbert

(57) ABSTRACT

The invention provides a lubricating composition containing an oil of lubricating viscosity and a detergent. The invention further relates to a process to prepare the detergent, and the use of the lubricating composition in a mechanical device such as an internal combustion engine, or a driveline device.

24 Claims, No Drawings

LUBRICATING COMPOSITION CONTAINING A DETERGENT

CROSS REFERENCE TO RELATED APPLICATION

This application claims priority from PCT Application Ser. No. PCT/US2011/065330 filed on Dec. 16, 2011, which claims the benefit of U.S. Provisional Application No. 61/425,274 filed on Dec. 21, 2010.

FIELD OF INVENTION

The invention provides a lubricating composition containing an oil of lubricating viscosity and a detergent. The invention further relates to a process to prepare the detergent and the use of the lubricating composition in a mechanical device such as an internal combustion engine or a driveline device.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on mechanical devices (such as internal combustion engines or driveline devices). Harmful effects may include possible wear (in both iron and aluminium based components), bearing corrosion, increased acid accumulation (due to lack of neutralisation of combustion by-products), or reduction in fuel economy.

A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Other additives may also increase lead corrosion.

Other art known to a skilled person includes a number of publications disclosing esters or amides or imides of carboxylic acids, or esters or amides or imides of hydroxycarboxylic acid as possible antiwear agents. The publications include Canadian Patent CA 1 183 125; East German Patent DD 299533 A5; International Publications WO 2006/044411, WO 2005/087904, WO2008/070307; Japanese Patent Applications 2005139238 A, 10183161A, 10130679A, and 05117680A; US Patent Applications 2010/0190669, 2010/0197536, and 2010/0093573, 20050198894; and U.S. Pat. Nos. 4,237,022, 5,338,470, 4,436,640, 4,157,970, 4,863,622, 5,132,034, 5,215,549, and 6,127,327.

Detergents such as metal sulphonates, metal phenates, metal salicylates, and metal salixarates are known. The detergents may be prepared in the presence or absence of a carboxylic acid. For example carboxylic acid-modified detergents are disclosed in EP 271 262 A, EP 273 588 A, U.S. Pat. Nos. 5,792,735 and 5,674,821. Typical acids disclosed therein may be defined by the formula $RCH(R^1)CO_2H$, wherein R is a $C_{10}$ to $C_{24}$ alkyl group and $R^1$ is hydrogen or a $C_1$ to $C_4$ alkyl group. An exemplified acid-modified detergent includes a hydrocarbyl-substituted phenate that contains 12 to 20 by weight of stearic acid. U.S. Pat. No. 3,155,617 discloses a means of activating calcium oxide (prepared from roasting calcium carbonate), so that it is useful in the methanol process for preparing dispersions of calcium carbonate. The calcium oxide is treated in methanol suspension with a small amount of an acid such as acetic acid.

SUMMARY OF THE INVENTION

The objectives of the present invention include to provide at least one of antiwear performance, friction modification (particularly for enhancing fuel economy), or detergent performance.

As used herein reference to the amounts of additives present in the lubricating composition disclosed herein are quoted on an oil free basis, i.e., amount of actives, unless otherwise indicated.

In one embodiment the present invention provides a process to prepare a detergent comprising:

(a) reacting in the presence of a solvent (typically an oil medium, or a hydrocarbon solvent such as an alkane (typically hexane), or toluene), a mixture of (i) an acidic detergent substrate, and (ii) a basic metal compound, and optionally further in the presence of an alcohol;

(b) optionally reacting the product of (a) with carbon dioxide to form an overbased detergent; and (c) optionally, removing volatiles (typically solvent, water or alcohol) from the product of (a) or (b), wherein a hydroxycarboxylic acid, or reactive equivalent thereof is added to at least one of any required step selected from the group consisting of (a), (b), (c), and mixtures thereof of step (a) to (c).

As used herein the expression "added to at least one of any required step" is intended to mean that the hydroxycarboxylic acid, or reactive equivalent thereof, is added to any of the steps that are actually performed in the practice of this invention. For example, if steps (a) and (b) are performed then the hydroxycarboxylic acid, or reactive equivalent thereof, may be added at either step (a) or step (b), or even in both steps (a) and (b). Likewise if steps (a) and (c) are performed. Likewise if steps (a), (b) and (c) are performed.

As used herein the expression "a hydroxycarboxylic acid, or reactive equivalent thereof" includes an acid, an anhydride, a metal salt, an ammonium salt, an amine salt or an ester. In one embodiment the hydroxycarboxylic acid, or reactive equivalent thereof may include either an acid or anhydride, typically an acid.

A metal salt may be derived from a metal such as an alkali metal or alkaline earth metal, or mixtures thereof. The metal may include lithium, sodium, potassium, calcium or magnesium. The metal may include calcium or magnesium.

The oil medium may be the same as an oil of lubricating viscosity, as is described below.

In one embodiment, the process of step (b) is required, resulting in the process preparing an overbased detergent, and wherein the detergent has a TBN of 200 to 600, or 300 to 550, or 350 to 500 mg KOH/g.

In one embodiment, the process step (b) is not performed, resulting in the process preparing a non-overbased detergent (may also be referred to as a neutral detergent). The TBN of a non-overbased detergent may be 20 to less than 200, or 30 to 100, or 35 to 50 mg KOH/g. When a detergent is prepared from a strong acid such as a hydrocarbyl-substituted sulphonic acid, the TBN may be lower (for example 0 to 50 mg KOH/g, or 10 to 20 mg KOH/g).

In one embodiment the acidic detergent substrate may be a hydrocarbyl-substituted sulphonic acid, a hydrocarbyl-substituted hydroxy-aromatic acid (such as salixaranes or salicylates), or mixtures thereof. In one embodiment the acidic detergent substrate may be a hydrocarbyl-substituted organic acid or a hydrocarbyl-substituted phenol. In one embodiment the acidic detergent substrate may be a hydrocarbyl-substituted sulphonic acid, or mixtures thereof.

In one embodiment the invention provides a process to prepare a detergent comprising:

(a) reacting in the presence of a solvent (typically an oil medium, or a hydrocarbon solvent such as an alkane (typically hexane), or toluene), a mixture of:

(i) an acidic detergent substrate, and (ii) a basic metal compound, and optionally further in the presence of an alcohol;

(b) reacting the product of (a) with carbon dioxide to form an overbased detergent; and (c) optionally, removing volatiles (typically solvent, water or alcohol) from the product of (a) or (b), wherein a hydroxycarboxylic acid, or reactive equivalent thereof is added to at least one of step (a), (b), or mixtures thereof of step (a) or (b).

In one embodiment the invention provides a process to prepare a detergent comprising:

(a) reacting in the presence of a solvent (typically an oil medium, or a hydrocarbon solvent such as an alkane (typically hexane), or toluene), a mixture of:

(i) an acidic detergent substrate, and (ii) a basic metal compound, and optionally further in the presence of an alcohol;

(b) reacting the product of (a) with a hydroxy-carboxylic acid, or reactive equivalent thereof, and carbon dioxide to form an overbased detergent; and (c) optionally, removing volatiles (typically solvent, water or alcohol) from the product of (a) or (b).

In one embodiment the invention provides a process to prepare a detergent comprising:

(a) reacting in the presence of a solvent (typically an oil medium, or a hydrocarbon solvent such as an alkane (typically hexane), or toluene), and optionally further in the presence of an alcohol, a mixture of (i) a hydroxy-carboxylic acid, (ii) an acidic detergent substrate, and (iii) a basic metal compound;

(b) reacting the product of (a) with carbon dioxide to form an overbased detergent; and (c) optionally, removing volatiles (typically solvent, water or alcohol) from the product of (b).

The invention may also provide for a product obtained/obtainable by the process described herein.

The invention may also provide for a lubricating composition comprising an oil of lubricating viscosity and a product obtained/obtainable by the process described herein.

In one embodiment the invention provides for a method of lubricating a mechanical device with a lubricating composition disclosed herein. The mechanical device may be an internal combustion engine or a driveline device.

The internal combustion engine may have a steel surface on at least one of a cylinder bore, cylinder block, or piston ring.

The internal combustion engine may have an aluminium alloy, or aluminium composite surface on at least one of a cylinder bore, cylinder block, or piston ring.

The driveline device may be a manual transmission that may or may not contain a synchronizer system, or an axle.

In one embodiment the invention provides for the use of a detergent of the present invention as also providing antiwear performance or friction control performance.

In one embodiment the invention provides for the use of a detergent of the present invention as also providing antiwear performance or friction control performance in a lubricating composition for an internal combustion engine.

In one embodiment the invention provides for the use of a detergent of the present invention as also providing antiwear performance or friction control performance in a lubricating composition for a driveline device.

The product obtained/obtainable by the process described herein may be present in the range of 0.01 wt % to 8 wt %, or 0.1 wt % to 6 wt %, or 0.15 wt % to 5 wt %, or 0.2 wt % to 3 wt % of the lubricating composition. In one embodiment the compound may be present at 0.2 wt % to 3 wt % of the lubricating composition.

DETAILED DESCRIPTION OF THE INVENTION

The present invention provides a detergent, a process to prepare a detergent, a lubricating composition, a method for lubricating a mechanical device and a use as disclosed above.

Basic Metal Compound

The metal basic compound is used to supply basicity to the detergent. The basic metal compound is a compound of a hydroxide or oxide of the metal.

Within the metal compound, the metal is typically in the form of an ion. The metal may be monovalent, divalent, or trivalent. When monovalent, the metal ion M may be an alkali metal, when divalent, the metal ion M may be an alkaline earth metal, and when trivalent the metal ion M may be aluminium. The alkali metal may include lithium, sodium, or potassium, or mixtures thereof, typically sodium. The alkaline earth metal may include magnesium, calcium, barium or mixtures thereof, typically calcium or magnesium.

Examples of metal basic compounds with hydroxide functionality include lithium hydroxide, potassium hydroxide, sodium hydroxide, magnesium hydroxide, calcium hydroxide, barium hydroxide and aluminium hydroxide. Suitable examples of metal basic compounds with oxide functionality include lithium oxide, magnesium oxide, calcium oxide and barium oxide. The oxides and/or hydroxides can be used alone or in combination. The oxides or hydroxides may be hydrated or dehydrated, although hydrated is typical (for calcium, at least). In one embodiment the metal basic compound may be calcium hydroxide, which may be used alone or mixtures thereof with other metal basic compounds. Calcium hydroxide is often referred to as lime. In one embodiment the metal basic compound may be calcium oxide which can be used alone or mixtures thereof with other metal basic compounds.

Acidic Detergent Substrate

In different embodiments the process of the invention forms a neutral detergent, or an overbased detergent. In one embodiment the process described herein provides a product that may be described as "overbased". The expression "overbased" is known to a person skilled in the art.

Overbased materials, otherwise referred to as overbased or superbased salts, are generally single phase, homogeneous Newtonian systems characterised by a metal content in excess of that which would be present for neutralisation according to the stoichiometry of the metal and the particular acidic organic compound reacted with the metal.

The amount of metal is commonly expressed in terms of substrate to metal ratio. The terminology "metal ratio" is used in the prior art and herein to designate the ratio of the total chemical equivalents of the metal in the overbased salt to the chemical equivalents of the metal in the salt which would be expected to result in the reaction between the hydrocarbyl-substituted organic acid; the hydrocarbyl-substituted phenol or mixtures thereof to be overbased and the basically reacting metal compound according to the known chemical reactivity and stoichiometry of the two reactants. Thus, in a normal or neutral salt the metal ratio is one and, in an overbased salt, the metal ratio is greater than one. The overbased metal salt of the hydrocarbyl-substituted organic acid; the hydrocarbyl-substituted phenol or mixtures thereof used in this invention usually have metal ratios not exceeding 40:1 (or 40). Often, salts having ratios of 2:1 to 35:1 are used. Such overbased materials are well known to those skilled in the art. Patents describing techniques for making basic salts of sulphonic acids, carboxylic acids, phenols, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

A more detailed description of the expressions "metal ratio", TBN and "soap content" are known to a person skilled in the art and explained in standard textbook entitled "Chemistry and Technology of Lubricants", Third Edition, Edited by R. M. Mortier and S. T. Orszulik, Copyright 2010, pages 219 to 220 under the sub-heading 7.2.5. Detergent Classification.

The detergent may be formed by the reaction of the basic metal compound, and an acidic detergent substrate. The acidic detergent substrate may include an alkyl phenol, an aldehyde-coupled alkyl phenol, a sulphurised alkyl phenol, an alkyl aromatic sulphonic acid (such as, alkyl naphthalene sulphonic acid, alkyl toluene sulphonic acid or alkyl benzene sulphonic acid), an aliphatic carboxylic acid, a calixarene, a salixarene, an alkyl salicylic acid, or mixtures thereof.

Collectively, when the alkyl phenol, the aldehyde-coupled alkyl phenol, and the sulphurised alkyl phenol are used to prepare a detergent, the detergent may be referred to as a phenate.

As used herein the TBN values quoted and associated range of TBN is on "an as is basis" i.e., containing conventional amounts of diluent oil which is used to handle viscosity. Conventional amounts of diluent oil typically range from 30 wt % to 60 wt % (often 40 wt % to 55 wt %) of the detergent component.

The TBN of a phenate may vary from less 200, or 30 to 175 (typically 155 mg KOH/g for a neutral phenate to 200 or more to 500, or 210 to 400 (typically 250-255) mg KOH/g for an overbased phenate.

The alkyl group of a phenate (i.e., an alkyl phenate) may contain 4 to 80, or 6 to 45, or 8 to 20, or 9 to 15 carbon atoms.

In one embodiment the acidic or neutralised detergent substrate comprises one or more of alkyl aromatic sulphonic acid, calixarene, salixarene, alkyl salicylic acid, carboxylate or mixtures thereof.

When the detergent is formed, the common nomenclature for the neutral or overbased detergent is a salixarate (from calixarene or salixarene), a sulphonate (from aromatic sulphonic acid, typically a benzene sulphonic acid), a salicylate (from alkyl salicylic acid), or a phenate (from alkyl phenol, aldehyde-coupled alkyl phenol, sulphurised alkyl phenol), or a saligenin.

In one embodiment the detergent may be a sulphonate, or mixtures thereof. The sulphonate may be prepared from a mono- or di-hydrocarbyl-substituted benzene (or naphthalene, indenyl, indanyl, or bicyclopentadienyl) sulphonic acid, wherein the hydrocarbyl group may contain 6 to 40, or 8 to 35 or 9 to 30 carbon atoms.

The hydrocarbyl group may be derived from polypropylene or a linear or branched alkyl group containing at least 10 carbon atoms. Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof.

In one embodiment the hydrocarbyl-substituted sulphonic acid may include polypropene benzenesulphonic acid and $C_{16}$-$C_{24}$ alkyl benzenesulphonic acid, or mixtures thereof.

When neutral or slightly basic, a sulphonate detergent may have TBN of less than 100, or less than 75, typically 20 to 50 mg KOH/g, or 0 to 20 mg KOH/g.

When overbased, a sulphonate detergent may have a TBN greater than 200, or 300 to 550, or 350 to 450 mg KOH/g.

A salicylate detergent may be derived from an alkyl-substituted salicylic acid. The TBN of a neutral salicylate may be 50 to 200, or 75 to 175 mg KOH/g. An overbased salicylate may have a TBN of greater than 200 to 400, or 225 to 350 mg KOH/g.

The alkyl group of a salicylate may contain 4 to 80, or 6 to 45, or 8 to 20, or 9 to 18 carbon atoms. In different embodiments the alkyl group of a salicylate may contain 12 or 16 carbon atoms.

Chemical structures for sulphonates, phenates and salicylates detergents are known to a person skilled in the art. The standard textbook entitled "Chemistry and Technology of Lubricants", Third Edition, Edited by R. M. Mortier and S. T. Orszulik, Copyright 2010, pages 220 to 223 under the sub-heading 7.2.6 provide general disclosures of said detergents and their structures.

A saligenin detergent is described in U.S. Pat. No. 7,285,516 in column 3, line 47 to column 5, line 63.

A salixarate detergent is described in U.S. Pat. No. 7,285,516 in column 5, line 64 to column 7, line 53. In general terms a salixarate is derived from coupling a hydrocarbyl-substituted phenol with (an optionally hydrocarbyl-substituted) salicylic acid in the presence of formaldehyde. Salixarate derivatives and methods of their preparation are also described in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." An overbased salixarate may have a TBN of 170 to 300 mg KOH/g. A neutral salixarate may have a TBN of 50 to less than 170 mg KOH/g.

In one embodiment the detergent may be a carboxylate derived from an aliphatic carboxylic acid. The aliphatic acid may contain 6 to 30, or 7 to 16 carbon atoms. Examples of a suitable carboxylic acid include caprylic acid, capric acid, lauric acid, myristic acid, myristoleic acid, decanoic acid, dodecanoic acid, pentadecanoic acid, palmitic acid, palmitoleic acid, margaric acid, stearic acid, 12-hydroxystearic acid, oleic acid, ricinoleic acid, linoleic acid, arachidic acid, gadoleic acid, eicosadienoic acid, behenic acid, erucic acid, tall oil fatty acids, rapeseed oil fatty acid, linseed oil fatty acid, or mixtures thereof. In one embodiment the aliphatic acids are oleic acid or tall oil fatty acid.

The carboxylate may have a metal ratio of 0.2 to 10, or from 0.5 to 7, or from 0.7 to 5. When overbased, the metal ratio is greater than one.

In one embodiment the acidic or neutralised detergent substrate comprises mixtures of at least two of said substrates. When two or more detergent substrates are used, the overbased detergent formed may be described as a complex/hybrid. Typically, the complex/hybrid may be prepared by reacting, in the presence of the basic metal compound and acidifying overbasing agent, alkyl aromatic sulphonic acid at least one alkyl phenol (such as, alkyl phenol, aldehyde-coupled alkyl phenol, sulphurised alkyl phenol) and optionally alkyl salicylic acid. An detergent substrate used to prepare a complex or hybrid may be prepared as is disclosed in WO97/46643 (also published as U.S. Pat. No. 6,429,179).

The detergent substrate and the hydroxy-carboxylic acid are present as reactants with a mole ratio of the detergent substrate to the hydroxy-carboxylic acid in the range of 20:1 to 1:2, or 20:1 to 1:1, or 18:1 to 1:1.

When the detergent substrate is a sulphonate, the mole ratio of the detergent substrate to the hydroxy-carboxylic acid may vary from 5:1 to 1:1, or 3:1 to 1:1.

When the detergent substrate is a phenate, the mole ratio of the detergent substrate to the hydroxy-carboxylic acid may vary from 18:1 to 1:1, or 18:1 to 8:1.

When the detergent substrate is a salicylate, the mole ratio of the detergent substrate to the hydroxy-carboxylic acid may vary from 10:1 to 1:1, or 8:1 to 5:1.

When the detergent substrate is a salixarate, the mole ratio of the detergent substrate to the hydroxy-carboxylic acid may vary from 5:1 to 1:1, or 3:1 to 1:1.

Hydroxycarboxylic Acid

The hydroxy-carboxylic acid may typically be non-aromatic. The hydroxy-carboxylic acid may be represented by the formula:

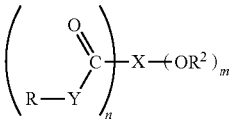

wherein n and m may be independently integers of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y may be independently —O—, >NH, or >$NR^1$ or two Ys together representing the nitrogen of an imide structure R—N< formed between two carbonyl groups; and each R and $R^1$ may be independently hydrogen or a hydrocarbyl group, each $R^2$ may be independently hydrogen, a hydrocarbyl group or an acyl group, further provided that at least one —$OR^2$ group is located on a carbon atom within X that is α or β to at least one of the —C(O)—Y—R groups, with the proviso that at least one of R and $R^2$ is hydrogen (typically all R and $R^2$s are hydrogen).

The hydroxy-carboxylic acid may have 2 to 8, or 2 to 6, or 2 to 4, or 2 to 3 carboxylic acid groups. In one embodiment the hydroxy-carboxylic acid may have at least two carboxylic acid groups.

The hydroxy-carboxylic acid may be tartaric acid, citric acid, glycolic acid, lactic acid, malic acid, or mixtures thereof. The hydroxy-carboxylic acid may be, for instance, tartaric acid (n and m both equal 2), citric acid (n=3, m=1), malic acid (n=2, m=1), glycolic acid (n and m both equal 1), or mixtures thereof.

In one embodiment the hydroxy-carboxylic acid may be tartaric acid, malic acid, citric acid, glycolic acid, or mixtures thereof. In different embodiments the hydroxy-carboxylic acid may be citric acid, tartaric acid, or mixtures thereof. In one embodiment the hydroxy-carboxylic acid may be tartaric acid.

Solvent

The solvent may be either an oil of lubricating viscosity or a hydrocarbon solvent (typically the solvent may be an oil of lubricating viscosity). The process may or may not include the presence of a hydrocarbon solvent other than oil. If present, hydrocarbon solvents can include aliphatic hydrocarbons or aromatic hydrocarbons. Examples of suitable aliphatic hydrocarbons include hexane, heptane, octane, nonane, decane, undecane, dodecane, tridecane and mixtures thereof. Examples of suitable aromatic hydrocarbons include benzene, xylene, toluene and mixtures thereof. In one embodiment the process requires a solvent other than or in addition to oil. In another embodiment the process of the invention does not include a hydrocarbon solvent.

Alcohol

Optionally the process described herein may contain an alcohol, or mixtures thereof. The alcohol may be a mono-ol or polyol. The mono-ol may be methanol in a mixture with at least one other alcohol. The polyol may be ethylene glycol, propylene glycol, or mixtures thereof. In one embodiment the process described herein further includes an alcohol, or mixtures thereof. The alcohol may be referred to as a promoter.

The alcohols include methanol and a mixture of alcohols containing 2 to 10, or 2 to 6, or 2 to 5, or 3 to 5 carbon atoms. The mixture of alcohols containing 2 to 7 carbon atoms can include branched or linear alkyl chains or mixtures thereof, although branched is typical The mixture of alcohols may contain ethanol, propan-1-ol, propan-2-ol, butan-1-ol, butan-2-ol, isobutanol, pentan-1-ol, pentan-2-ol, pentan-3-ol, isopentanol, hexan-1-ol, hexan-2-ol, hexan-3-ol, heptan-1-ol, heptan-2-ol, heptan-3-ol, heptan-4-ol, 2-ethylhexanol, decan-1-ol or mixtures thereof. The mixture of alcohols contains at least one butanol and at least one amyl alcohol. A mixture of alcohols is commercially available as isoamyl alcohol from Union Carbide or other suppliers.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants include sulphurised olefins, diarylamines, alkylated diarylamines, hindered phenols, molybdenum compounds (such as molybdenum dithiocarbamates), hydroxylthioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butyl-phenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetra-ethylenepentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and a polyamine as described above.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

The dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased metal-containing detergent may be a zinc, sodium, calcium or magnesium salt of a phenate, sulphur containing phenate, sulphonate, salixarate or salicylate. Overbased salixarates, phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy.

Typically the overbased metal-containing detergent may be a calcium or magnesium an overbased detergent.

Overbased detergents are known in the art. Overbased materials, otherwise referred to as overbased or superbased salts, are generally single phase, homogeneous Newtonian systems characterized by a metal content in of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 3.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartrates, tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thio-carbamates, and bis(S-alkyldithiocarbamyl) disulphides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

Extreme Pressure (EP) agents that are soluble in the oil include sulphur- and chlorosulphur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulphurised olefins (such as sulphurised isobutylene), a hydrocarbyl-substituted 2,5-dimercapto-1,3,4-thiadiazole, or oligomers thereof, organic sulphides and polysulphides such as dibenzyl-disulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclo-hexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptyl-phenol diacid; amine salts of alkyl and dialkylphosphoric acids or derivatives including, for example, the amine salt of a reaction product of a dialkyl-dithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton37™ (FN 1380) and Exxon Mineral Seal Oil™ (FN 3200).

Industrial Application

The lubricating composition of the present invention may be useful in an internal combustion engine, a driveline device, a hydraulic system, a grease, a turbine, or a refrigerant. If the lubricating composition is part of a grease composition, the composition further comprises a thickener. The thickener may include simple metal soap thickeners, soap complexes, non-soap thickeners, metal salts of such acid-functionalized oils, polyurea and diurea thickeners, calcium sulphonate thickeners or mixtures thereof. Thickeners for grease are well known in the art.

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.1 wt % of the lubricating composition. In one embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

An engine lubricating composition may further include other additives. In one embodiment the invention provides a lubricating composition further comprising at least one of a dispersant, an antiwear agent, a dispersant viscosity modifier (other than the compound of the invention), a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

In one embodiment an engine lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or to 750 ppm 5 ppm to 300 ppm, or 20 ppm to 250 ppm of molybdenum.

An engine lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

The overbased detergent (other than the detergent of the present invention) may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

As used herein the term "soap" means the surfactant portion of a detergent and does not include a metal base, such as calcium carbonate. The soap term may also be referred to as a detergent substrate. For example, a phenate detergent soap or substrate is an alkylated phenol or a sulphur-coupled alkylated phenol, or a methylene-coupled alkylated phenol. Or for a sulphonate detergent, the soap or substrate is a neutral salt of an alkylbenzenesulphonic acid.

In one embodiment an internal combustion engine lubricating composition may have a soap content as delivered by detergents (including the detergent of the present invention) may be in the range of 0.06 wt % to less than 1.4 wt %, or 0.1 wt % to less than 1 wt %, or 0.15 wt % to 0.9 wt % of the lubricating composition.

Typically the internal combustion engine lubricating composition may employ a detergent of the present invention, wherein the hydroxy-carboxylic acid may have at least two carboxylic acid groups such as tartaric acid.

Useful corrosion inhibitors for an engine lubricating composition include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

An engine lubricating composition in different embodiments may have a composition as disclosed in the following table:

| | Embodiments (wt %) | | |
|---|---|---|---|
| Additive | A | B | C |
| Product of Invention | 0.01 to 8 | 0.1 to 6 | 0.15 to 5 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0.1 to 15 | 0.1 to 10 | 0.2 to 8 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Driveline Device

In one embodiment the method and lubricating composition of the invention may be suitable for a driveline device. The driveline device may be lubricated by at least one of a gear oil, an axle oil, a drive shaft oil, a traction oil, a manual transmission oil, an automatic transmission oil, or an off highway oil (such as a farm tractor oil). In one embodiment the invention provides a method of lubricating a manual transmission that may or may not contain a synchronizer system. In one embodiment the invention provides a method of lubricating an automatic transmission. In one embodiment the invention provides a method of lubricating an axle.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

Automatic transmissions can contain continuously slipping torque converter clutches (CSTCC), wet start and shifting clutches and in some cases may also include metal or composite synchronizers.

Dual clutch transmissions or automatic transmissions may also incorporate electric motor units to provide a hybrid drive.

A manual transmission lubricant may be used in a manual gearbox which may be unsynchronized or may contain a synchronizer mechanism. The gearbox may be self-contained or may additionally contain any of a transfer gearbox, planetary gear system, differential, limited slip differential or torque vectoring device, which may be lubricated by a manual transmission fluid.

The gear oil or axle oil may be used in a planetary hub reduction axle, a mechanical steering and transfer gear box in utility vehicles, a synchromesh gear box, a power take-off gear, a limited slip axle, and a planetary hub reduction gear box.

If the lubricating composition of the invention is suitable for a driveline device, a succinimide dispersant as generally described previously may be used. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150.

In one embodiment the dispersant for a driveline device may be a post treated dispersant. The dispersant may be post treated with dimercaptothiadiazole, optionally in the presence of one or more of a phosphorus compound, an aromatic dicarboxylic acid, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof (typically 2,5-dimercapto-1,3,4-thiadiazole, or oligomers thereof), (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

In one embodiment the oil soluble phosphorus amine salt antiwear agent includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

Examples of suitable secondary amines include bis-2-ethylhexyl amine, dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof.

Mixtures of amines may also be used in this optional antiwear agent. In one embodiment a useful mixture of amines is "Primene® 81R" and "Primene® JMT." Primene® 81R and Primene® JMT (both produced and sold by Rohm & Haas, or Dow Chemicals) are mixtures of C11 to C14 tertiary alkyl primary amines and C18 to C22 tertiary alkyl primary amines respectively.

In one embodiment oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in International Application PCT/US08/051,126 (or equivalent to U.S. application Ser. No. 11/627,405).

In one embodiment the hydrocarbyl amine salt of an alkylphosphoric acid ester is the reaction product of a C14 to C18 alkyl phosphoric acid with Primene 81R™ (produced and sold by Rohm & Haas, or Dow Chemicals) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid derived acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C.

Examples of suitable olefins that may be sulphurised to form a sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition may contain an overbased detergent that may or may not be borated. For example the lubricating composition may contain a borated overbased calcium or magnesium sulphonate detergent, or mixtures thereof.

A driveline device lubricating composition in different embodiments may have a composition as disclosed in the following table:

| | Embodiments (wt %) | | | |
|---|---|---|---|---|
| Additive | A | B | C | D |
| Product of Invention | 0.01 to 8 | 0.1 to 6 | 0.15 to 5 | 0.2 to 3 |
| Dispersant | 1 to 4 | 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 2 | 0.5 to 6 | 0.01 to 2 |
| Anti-oxidant | 0 to 5 | 0.01 to 2 | 0 to 3 | 0 to 2 |
| Antiwear Agent | 0.5 to 5 | 0.01 to 3 | 0.5 to 3 | 0.01 to 3 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 | 0 to 6 | 0 to 10 |
| Oil of Lubricating Viscosity | Balance to 100% | Balance to 100% | Balance to 100% | Balance to 100% |

Footnote:
The viscosity modifier in the table above may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

The following examples provide illustrations of the invention. These examples are non-exhaustive and are not intended to limit the scope of the invention.

EXAMPLES

Preparative Example 1 (Prep 1)

To a solution of diluent oil (512 g), alcohols (36.8 g), polyisobutylene succinic anhydride (36.8 g), lime (25 g) calcium chloride (1.55 g) and water (2.22 g) is added linear $C_{20-24}$-alkylbenzene sulphonic acid (228 g) portion wise at 20° C. The mixture is then heated to 100° C. and held to reflux for one hour 40 minutes. The reaction mixture is then allowed to warm to 150° C. under distillation conditions and held for 10 minutes before cooling to room temperature. To the cooled solution is added a calcium methylene coupled heptylphenate (64.6 g), alcohols (207.4 g), tartaric acid (32.4 g), water (4.2 g) and lime (62.3 g). The mixture is then warmed to 50° C. and carbonated via the introduction of gaseous carbon dioxide over 1 hour. Five further lime increments (62.3 g) are introduced followed by subsequent carbonations. The reaction mixture is then heated to 150° C. under distillation conditions, cooled to 100° C. and finally filtered to yield the final product.

Preparative Example 2 (Prep2)

To a solution of diluent oil (512 g), alcohols (36.8 g), polyisobutylene succinic anhydride (36.8 g), lime (25 g) calcium chloride (1.55 g) and water (2.22 g) is added linear alkylbenzene sulphonic acid (228 g) portion wise at 20° C. The mixture is then heated to 100° C. and held to reflux for one hour 40 minutes. The reaction mixture is then allowed to warm to 150° C. under distillation conditions and held for 10 minutes before cooling to room temperature. To the cooled solution is added a calcium methylene coupled heptylphenate (64.6 g), alcohols (207.4 g), glycolic acid (36.8 g), water (4.2 g) and lime (62.3 g). The mixture is then warmed to 50° C. and carbonated via the introduction of gaseous carbon dioxide over 1 hour. Five further lime increments (62.3 g) are introduced followed by subsequent carbonations. The reaction mixture is then heated to 150° C. under distillation conditions, cooled to 100° C. and finally filtered to yield the final product.

The amounts quoted in the examples below include conventional amounts of diluent oil. Typically diluent oil is present in dispersants and detergents and may vary from 30 wt % to 60 wt % diluent oil.

Internal Combustion Lubricant Evaluation

Comparative Example 1 (CE1)

is a 5W-30 engine oil lubricant containing 7.5 wt % of dispersant, 0.57 wt % of zinc dialkyldithiophosphate, 3.6 wt % of antioxidants (a mixture of phenolic, aminic antioxidants, and sulphurised olefin), 0.15 wt % of corrosion inhibitors, 0.29 wt % of a 80 TBN sulphonate detergent, and 1.80 wt % of 400 TBN sulphonate detergent. The balance is an API Group III base oil derived from a mixture of 4 $mm^2s^{-1}$ and 6 $mm^2s^{-1}$ oils. The lubricating composition has a sulphated ash content of 1 wt %, and a detergent soap content of 0.5 wt %.

Example 1 (EX1)

is similar to CE1, except it replaces the 400 TBN sulphonate detergent with 1.8 wt % of the product of Prep1.

Comparative Example 2 (CE2)

is similar to CE1, except it contains 1.53 wt % of 400 TBN sulphonate detergent and 1.19 wt % of a 80 TBN sulphonate detergent. The lubricating composition has a sulphated ash content of 1 wt %, and a detergent soap content of 1 wt %.

Example 2 (EX2)

is similar to CE2, except it replaces the 400 TBN sulphonate detergent with 1.53 wt % of the product of Prep1.

Comparative Example 3 (CE3)

is similar to CE1, except it further contains 0.5 wt % of $C_{12-14}$ alkyl tartrate.

Example 3 (EX3)

is similar to CE3, except it replaces the 400 TBN sulphonate detergent with 1.8 wt % of the product of Prep1.

CE1 to CE3 and EX1 to EX3 are evaluated for antiwear performance using a programmed temperature high frequency reciprocating rig (HFRR) available from PCS Instruments. HFRR conditions for the evaluations are 500 g load, 75 minute duration, 1000 micrometer stroke, 20 Hertz frequency, and temperature profile of 15 minutes at 40° C. followed by an increase in temperature to 160° C. at a rate of 2° C. per minute. The wear scar data obtained is measured and presented in the following table:

| Example | wt % Ash | wt % Soap | Wear Scar (μm) |
|---|---|---|---|
| CE1 | 1 | 0.5 | 178 |
| EX1 | 1 | 0.5 | 165 |
| CE2 | 1 | 1 | 178 |
| EX2 | 1 | 1 | 175 |
| CE3 | 1 | 0.5 | 198 |
| EX3 | 1 | 0.5 | 174 |

Driveline Lubricant Evaluation

Comparative Example 4 (CE4)

contains 0.25 wt % of 400 TBN calcium sulphonate detergent, 0.2 wt % of dibutyl phosphite, 0.5 wt % of aminic antioxidant, 2 wt % of a post-treated dispersant that has been reacted with terephthalic acid and boric acid, and base oil. The gear oil has a viscosity of 5.6 $mm^2/s$.

Comparative Example 5 (CE5)

is similar to CE4, containing 1 wt % of 400 TBN calcium sulphonate detergent.

Example 4 (EX4)

is similar to CE5, except it replaces 1 wt % of 400 TBN calcium sulphonate detergent with 1 wt % of the product of Prep1.

Example 5 (EX5)

is similar to CE5, except it replaces 1 wt % of 400 TBN calcium sulphonate detergent with 1 wt % of the product of Prep2.

CE4, CE5, EX4 and EX5 are evaluated for gear oil performance by FZG and VSFT test procedures.

The FZG test measures the antiscuffing properties of oil for reduction gears, hypoid gears, automatic transmission gears and the like. A description of the FZG test and the meaning of the results is found in the article "Scuffing Tests on Gear Oils in the FZG Apparatus" by G. Niemann, H. Rettig and G. Lechner in ASLE Transactions, 4 71-86 (1961). Test procedure DIN 51354 is utilized which is discussed in Prufung von Schmierstoffen: Mechanische Prufung von Gebriebeolen in der FZG-Zahnrad—Verspannungs—Prufmaschine, January 1970. The FZG test ratings below are based on FZG A10/16.6R/90 test. The results reported include load stage failure. Typically better results are obtained for lubricants reporting a higher load stage failure.

The VSFT test procedure consists of a disc that can be metal or another friction material which is rotated against a metal surface. The friction materials employed in the particular tests are various commercial friction materials commonly used in automatic transmission clutches, as indicated in the Tables. The test is run over three temperatures and two load levels. The coefficient of friction measured by the VSFT is plotted against the sliding speed (50 and 200 r.p.m.) over a number speed sweeps at a constant pressure. The results are initially presented as slope of the μ-v curve as a function of time, reported for 40, 80, and 120° C. and 24 kg and 40 kg (235 and 392 N) force, determined at 4 hour intervals from 0 to 52 hours. Typically, the slope will initially be positive, with a certain amount of variability, and may gradually decrease, possibly becoming negative after a certain period of time.

Overall, the present invention may provide at least one of antiwear performance, friction modification (particularly for enhancing fuel economy), or detergent performance.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs to [0141] of published application US 2010-0197536.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process to prepare a detergent comprising:

(a) reacting in the presence of a solvent comprising (i) an oil medium or (ii) a hydrocarbon solvent, a mixture of
  (i) an acidic detergent substrate, and
  (iii) a basic metal compound, and optionally further in the presence of an alcohol;

(b) reacting the product of (a) with a hydroxy-carboxylic acid, or reactive equivalent thereof, and carbon dioxide to form an overbased detergent; and (c) optionally, removing volatiles from the product of (a) or (b).

2. The process of claim 1, the process preparing an overbased detergent, wherein the detergent has a TBN of 200 to 600mg KOH/g.

3. The process of claim 1, wherein the basic metal compound is a hydroxide or oxide of the metal.

4. The process of claim 1, wherein the basic metal compound comprises a metal that is monovalent, divalent, or trivalent.

5. The process of claim 4, wherein the metal is an alkali metal or alkaline earth metal.

6. The process of claim 4, wherein the metal is lithium, sodium, potassium, magnesium, calcium, barium, or mixtures thereof.

7. The process of any claim 5, wherein the metal is calcium or magnesium.

8. The process of claim 1, wherein the acidic detergent substrate is a hydrocarbyl-substituted sulphonic acid, a hydrocarbyl-substituted hydroxy-aromatic acid, or mixtures thereof.

9. The process of claim 8, wherein the acidic detergent substrate is a hydrocarbyl-substituted sulphonic acid or mixtures thereof.

10. The process of claim 8, wherein the acidic detergent substrate is a hydrocarbyl-substituted organic acid or a hydrocarbyl-substituted phenol.

11. The process of claim 1, wherein the hydroxy-carboxylic acid is non-aromatic.

12. The process of claim 11, wherein the hydroxy-carboxylic acid is represented by the formula:

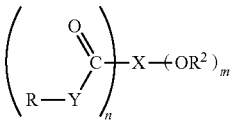

wherein n and m are independently integers of 1 to 5;

X is an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y is independently —O—, >NH, or >$NR^1$ or two Ys together representing the nitrogen of an imide structure R-N<formed between two carbonyl groups; and each R and $R^1$ is independently hydrogen or a hydrocarbyl group, each $R^2$ is independently hydrogen, a hydrocarbyl group or an acyl group, further provided that at least one —$OR^2$ group is located on a carbon atom within X that is α or β to at least one of the —C(O)—Y—R groups, with the proviso that at least one of R and $R^2$ is hydrogen.

13. The process of claim 12, wherein the hydroxy-carboxylic acid is tartaric acid, malic acid, citric acid, glycolic acid, or mixtures thereof.

14. The process of claim 13, wherein the hydroxy-carboxylic acid is tartaric acid, citric acid, or mixtures thereof.

15. The process of claim 12, wherein the hydroxy-carboxylic acid is lactic acid, malic acid, or mixtures thereof.

16. The process of claim 1, wherein the acidic detergent substrate and the hydroxy-carboxylic acid are present as reactants with a mole ratio of the acidic detergent substrate to the hydroxy-carboxylic acid in the range of 20:1 to 1:2.

17. A product obtained/obtainable by the process of claim 1.

18. A lubricating composition comprising an oil of lubricating viscosity and the product of claim 17.

19. The lubricating composition of claim 18, wherein the product is present in the range of 0.01 wt % to 8 wt of the lubricating composition.

20. A method of lubricating an internal combustion engine comprising supplying to the internal combustion engine a lubricating composition of claim 18.

21. The method of claim 20, wherein the internal combustion engine has a steel surface on a cylinder bore, cylinder block, or piston ring.

22. The method of claim 20, wherein the internal combustion engine has a surface of steel, or an aluminium alloy, or an aluminium composite.

23. A method of lubricating a driveline device comprising supplying to the driveline device a lubricating composition of claim 18.

24. The method of claim 23, wherein the driveline device includes a manual transmission that may or may not contain a synchronizer system, or an axle.

* * * * *